US010889435B2

(12) United States Patent
Jetter et al.

(10) Patent No.: US 10,889,435 B2
(45) Date of Patent: Jan. 12, 2021

(54) LEAF COLLECTION APPARATUS

(71) Applicant: JCS Ventures, LLC, Aurora, CO (US)

(72) Inventors: Roger Jetter, Aurora, CO (US); Robert Sonnichsen, Aurora, CO (US); Gary Constant, Golden, CO (US)

( * ) Notice: Subject to any disclaimer, the term of this patent is extended or adjusted under 35 U.S.C. 154(b) by 0 days.

(21) Appl. No.: 16/842,022

(22) Filed: Apr. 7, 2020

(65) Prior Publication Data

US 2020/0231379 A1 Jul. 23, 2020

Related U.S. Application Data

(63) Continuation of application No. 16/189,953, filed on Nov. 13, 2018.

(60) Provisional application No. 62/587,308, filed on Nov. 16, 2017.

(51) Int. Cl.

| | |
|---|---|
| ***B65F 1/10*** | (2006.01) |
| ***B65B 67/12*** | (2006.01) |
| ***B65B 67/04*** | (2006.01) |

(52) U.S. Cl.

CPC ..... *B65F 1/10* (2013.01); *B65B 67/04* (2013.01); *B65B 67/1238* (2013.01); *B65F 2220/102* (2013.01); *B65F 2240/138* (2013.01)

(58) Field of Classification Search

CPC .. B65F 1/10; B65F 67/1238; B65F 2220/102; B65F 2240/138; B65F 1/1415; B65B 67/1205; B65B 7/04; B65B 67/12; B65B 67/1255

See application file for complete search history.

(56) References Cited

U.S. PATENT DOCUMENTS

| | | | | | |
|---|---|---|---|---|---|
| 3,697,030 | A | | 10/1972 | Schultz | |
| 3,747,653 | A | | 7/1973 | Ringer | |
| 3,934,803 | A | | 1/1976 | Paulus | |
| 3,998,415 | A | | 12/1976 | D'Antonio et al. | |
| 4,006,928 | A | | 2/1977 | Beugin | |
| 4,052,764 | A | * | 10/1977 | Groff | A47L 13/52 15/257.9 |
| 4,434,829 | A | | 3/1984 | Barnard | |
| 4,548,372 | A | | 10/1985 | Lutzker | |
| 4,550,440 | A | | 10/1985 | Rico | |
| 4,615,743 | A | | 10/1986 | Bylenga | |
| 4,659,045 | A | | 4/1987 | Flynn | |
| 4,664,348 | A | | 5/1987 | Corsaut et al. | |
| 4,749,011 | A | * | 6/1988 | Rylander | B65B 67/1238 141/114 |
| 4,787,753 | A | | 11/1988 | Barnhart | |
| 4,832,291 | A | * | 5/1989 | Nelson | B65B 67/1238 248/99 |
| 4,832,292 | A | | 5/1989 | Beckham | |
| 4,884,603 | A | | 12/1989 | Simpson | |
| 5,009,378 | A | | 4/1991 | Linsmeyer et al. | |
| 5,011,103 | A | | 4/1991 | Hayes et al. | |
| 5,014,943 | A | * | 5/1991 | Nelson | B65B 67/1205 141/316 |
| 5,044,774 | A | | 9/1991 | Bullard et al. | |

(Continued)

*Primary Examiner* — Christopher Garft
(74) *Attorney, Agent, or Firm* — Kenneth Altshuler

(57) ABSTRACT

An apparatus for the collection of debris such as leaves and other yard debris having a flat-pack configuration and a hoop-like configuration. In a hoop-like configuration, the apparatus allows the fixation of a bag such that the bag is held open and allows the user to dispose debris through the apparatus and into the bag.

16 Claims, 7 Drawing Sheets

(56) References Cited

U.S. PATENT DOCUMENTS

| | | | | |
|---|---|---|---|---|
| 5,065,965 | A | 11/1991 | Aulabaugh | |
| 5,082,219 | A | 1/1992 | Blair | |
| 5,090,756 | A * | 2/1992 | Pfisterer | B65B 67/1238 248/95 |
| 5,183,339 | A | 2/1993 | Williams | |
| 5,261,553 | A * | 11/1993 | Mueller | B65F 1/06 220/495.1 |
| 5,372,269 | A * | 12/1994 | Sutton | B65D 3/04 220/4.09 |
| 5,743,651 | A | 4/1998 | Steinmetz | |
| 5,806,815 | A | 9/1998 | Knutson | |
| 6,030,010 | A | 2/2000 | Graeff | |
| 6,340,037 | B1 * | 1/2002 | Stafford | B65B 67/1205 141/316 |
| 6,450,461 | B1 | 9/2002 | Lohmann | |
| 7,546,989 | B1 | 6/2009 | Lineberry et al. | |
| 2004/0195468 | A1 * | 10/2004 | Singleton | B65F 1/00 248/99 |
| 2005/0087657 | A1 | 4/2005 | Oran | |
| 2006/0144467 | A1 | 7/2006 | Butzer et al. | |
| 2008/0044111 | A1 | 2/2008 | Faraone | |
| 2009/0097780 | A1 | 4/2009 | Chapman et al. | |
| 2011/0309210 | A1 * | 12/2011 | Muse | B65B 67/1205 248/99 |
| 2012/0012228 | A1 | 1/2012 | Karabas et al. | |

* cited by examiner

LEAF COLLECTION APPARATUS

CROSS REFERENCE TO REFERENCE TO RELATED APPLICATIONS

This application claims the benefit of U.S. patent application Ser. No. 16/189,953 entitled "LEAF COLLECTION APPARATUS" filed on Nov. 13, 2018, which claims the benefit of U.S. Provisional Patent Application No. 62/587,308 entitled "LEAF COLLECTION APPARATUS" filed on Nov. 16, 2017, the entire contents of which are incorporated herein by reference in its entirety for all purposes.

FIELD OF THE INVENTION

The present invention is directed to the field of the collection and disposal of debris such as dust, yard waste or other types of debris.

BACKGROUND OF THE INVENTION

The collection of matter such as dust, trash, yard waste, or other general debris, herein referred to as debris, is a common activity for maintaining the cleanliness of an area. Debris collection may be necessary as general cleaning and maintenance, or following activities such as construction. Another common need for debris collection surrounds annual leaf collection or other debris producing events.

The collection of debris commonly surrounds the aggregation of debris, the transfer of debris to a receptacle, placing the debris within the receptacle and then the disposal of the receptacle into the waste stream.

The aggregation of debris is typically performed with an aggregating device such as a broom, rake or other device appropriate for the type of debris for collection. The transferring of the debris is typically performed with a transferring device such as a shovel, dustpan, rake, or other device appropriate for the type of debris being transferred. The transferring device is used to transfer the debris from the area in which it is aggregated to a receptacle such as a trash bag. In certain situations, an intermediate receptacle such as a bucket, is used to hold the debris prior to the transferring to a receptacle.

A typical process surrounding debris collection and disposal requires the flexion of one's back and knees in a repetitive manner. Repetitive motions such as this are inefficient, tiresome and can be painful or injurious. Sometimes, when collecting debris, an individual is required to kneel on the ground, which can be difficult and/or painful for some individuals. Collection of debris in a traditional manner can result in an individual developing or exacerbating conditions such as prepatellar bursitis, arthritis, or repetitive motion disorders of the spine, knees or other joints.

In light of the potential injurious nature of debris collection and disposal, there is a need for an apparatus that assists in preventing repetitive motion, limiting joint flexion, and making the process of debris collection more efficient.

SUMMARY OF THE INVENTION

It is an object of the present invention to allow users to collect and dispose of debris in a manner which is more time and energy efficient while limiting knee and back flexion, thus reducing potential for injurious conditions. Certain embodiments of the present invention provide solutions to limit the number of steps required for collecting and disposing of debris. Certain embodiments surround the aggregation of debris directly into a receptacle, such as a bag. Aggregating debris directly into a receptacle omits the step of transferring the debris from the area of aggregation to a receptacle, thus making the process of collecting and disposing of debris more efficient.

Certain existing technologies have attempted to provide a solution to the problem providing an apparatus for the collection and disposal of debris. Inventions such as those disclosed by U.S. Pat. No. 3,998,415 to D'Antonio, et al. ("D'Antonio"), incorporated by reference herein, provides an apparatus for holding a bag open. However, D'Antonio requires the use of many parts. The misplacement of any part renders the apparatus inoperable. Similarly, the "Rake Mate" disclosed in U.S. Pat. No. 5,009,378 to Linsmeyer ("Linsmeyer"), incorporated by reference herein, also requires the use of many parts. Additionally, the invention of Linsmeyer is bulky, resulting in high cost of shipping and requires a large amount of space for storage when not in use.

Inventions such as those disclosed by U.S. Pat. No. 5,011,103 to Hayes, et al. ("Hayes"), U.S. Pat. No. 5,183,339 to Williams ("Williams"), and U.S. Pat. No. 4,615,743 to Bylenga ("Bylenga"), U.S. Patent Application No. 2005/0087657 to Dran ("Dran"), all incorporated by reference herein, fail to hold a bag in a manner for the leading edge of the bag to rest at the same level of the aggregated debris. As a result, some debris pushed toward the open bag held by each apparatus is disposed under the leading edge of the bag or against the leading edge of the bag rather than into the bag. Furthermore, the invention of Hayes requires the use of a specialized bag which must then be emptied into a second bag, counteracting a potential benefit of efficiency in the collection and disposal of debris.

Inventions such as those disclosed by U.S. Pat. No. 4,659,045 to Flynn ("Flynn") and U.S. Pat. No. 6,450,461 to Lohmann ("Lohmann"), incorporated by reference herein, result in an apparatus which are large and cumbersome. The shipping and storage of such apparatus require a large amount of storage space and are costly to ship. Furthermore, the handles of Flynn are located toward the bottom of the apparatus and require a user to repeatedly put their back and/or knees in a state of flexion.

Inventions such as disclosed by U.S. Pat. No. 4,664,348 to Corsaut ("Corsaut"), incorporated by reference herein, provide a low-profile apparatus for holding a bag. Corsaut discloses an apparatus, which can be configured to lay flat when not in use to provide ease of transport and storage. However, the invention of Corsaut fails to provide a user with a handle to assist in manipulating the apparatus, thus resulting in requiring a user to repeatedly put their back and/or knees in flexion.

It is an aspect of the certain embodiments of the present invention to hold a bag in an open configuration.

It is an aspect of the present invention to allow a user to use embodiments of the present invention without the need to kneel, or place their back in flexion. Certain embodiments of the present invention provide a handle located at a high-point of the apparatus.

It is an aspect of various embodiments to allow the storage and/or transportation of an apparatus without requiring a large volume for shipping or storage when not in use. Certain embodiments of the present invention have a flat-pack structure. A flat-pack structure provides increased transportability and minimizing storage space when the apparatus is not in use. Such an apparatus comprises a scoop with a leading edge configured to rest upon a ground surface and extensions affixed to the sides of scoop. The extensions, made of a flexible material are typically hinged at the sides of the scoop and are configured to hinge toward the scoop. When hinged toward the scoop, the extensions flexibly interface with each other to create a hoop configuration. The extensions are mated to each other in a manner to maintain the hoop configuration. The hoop configuration is then disposed into the open end of a bag such that the leading edge of the scoop extends out of the bag opening and a trailing edge of the scoop extends into the bag. Thus, the apparatus keeps the bag open and the leading edge of the apparatus provides a low-profile edge for ease of depositing debris through the apparatus and into the bag.

Certain embodiments of the present invention comprise a scoop having a bevel on the leading edge. The bevel of the leading edge of the scoop allows for easier depositing of debris through the apparatus without the debris catching on the leading edge of the scoop.

Certain embodiments comprise retention mechanisms for the attachment of a trash-bag, or other receptacle, to the apparatus. Retention mechanisms typically serve to attach a receptacle to an exterior surface of the apparatus. However, it will be appreciated that if desired, a retention mechanism for affixing a receptacle to the interior surface of the apparatus does not depart from the inventive concept of the present invention. It will be further appreciated that retention mechanisms of many types provide retention of a trash bag while in keeping with the inventive nature of the present invention. Such retention mechanisms include: holes, snap closures, and other mechanisms consistent with the inventive nature of the present invention.

These and other advantages will be apparent from the disclosure of the inventions contained herein. The above-described embodiments, objectives, and configurations are neither complete nor exhaustive. As will be appreciated, other embodiments of the invention are possible using, alone or in combination, one or more of the features set forth above or described in detail below. Further, this Summary is neither intended nor should it be construed as being representative of the full extent and scope of the present invention. The present invention is set forth in various levels of detail in this Summary, as well as in the attached drawings and the detailed description below, and no limitation as to the scope of the present invention is intended to either the inclusion or non-inclusion of elements, components, etc. in this Summary. Additional aspects of the present invention will become more readily apparent from the detailed description, particularly when taken together with the drawings, and the claims provided herein.

BRIEF DESCRIPTION OF THE DRAWINGS

FIG. 4B—A perspective assembled view of embodiments of the present invention FIG. 5A—A close-up view of extension attachments of certain embodiments FIG. 5B—A perspective assembled view of embodiments of the present invention FIG. 6A—A perspective assembled view of embodiments of the present invention FIG. 6B—A close-up view of retention components of certain embodiments FIG. 7A—A perspective assembled view of embodiments of the present invention FIG. 7B—A close-up view of retention components of certain embodiments

DETAILED DESCRIPTION OF VARIOUS EMBODIMENTS

Figure 1:
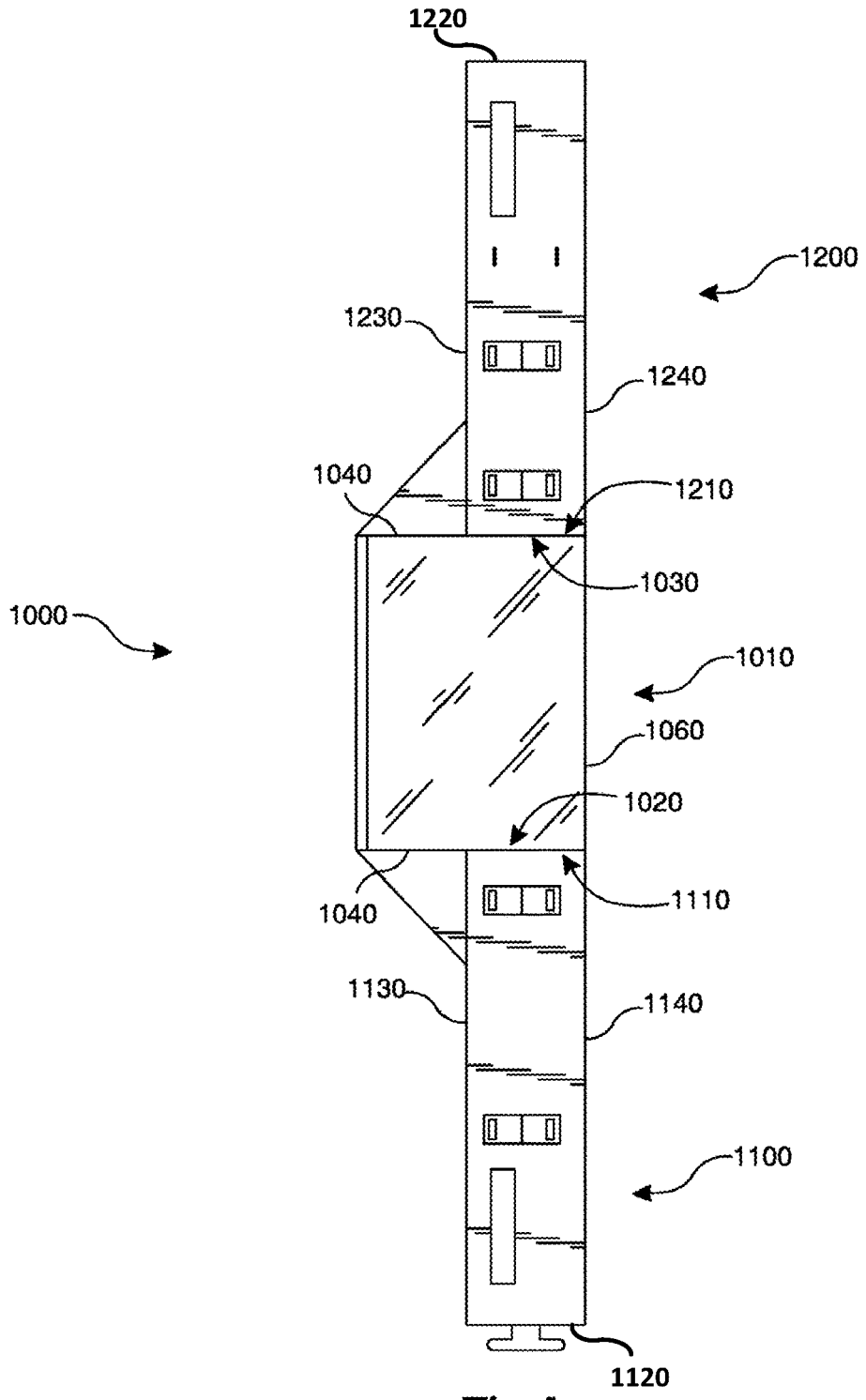
FIG. 1—A plan-view of embodiments in a flat-configuration

Certain embodiments of the invention comprise a bag holding apparatus 1000, shown in FIG. 1 having a sheet-form manufactured from a flexible material, typically having elastic or semi-elastic properties. The apparatus comprises a scoop 1010, having a first end 1020 and second end 1030. Affixed to the first end 1020 of the scoop, is a first extension 1100 having a first end 1110 affixed to the first end 1020 of the scoop. Affixed to the second end 1030 of the scoop is a second extension 1200 having a first end 1210 affixed the second end 1030 of the scoop.

It will be appreciated that an apparatus 1000, as shown in FIG. 1, comprises a scoop 1010, a first extension 1100, and a second extension 1200 having a singular form cut from a single piece of sheet-stock or plate-stock. In other embodiments of the present invention, a scoop 1010, a first extension 1100, and a second extension 1200 are independent structures which are assembled and affixed as described herein.

Figure 2:
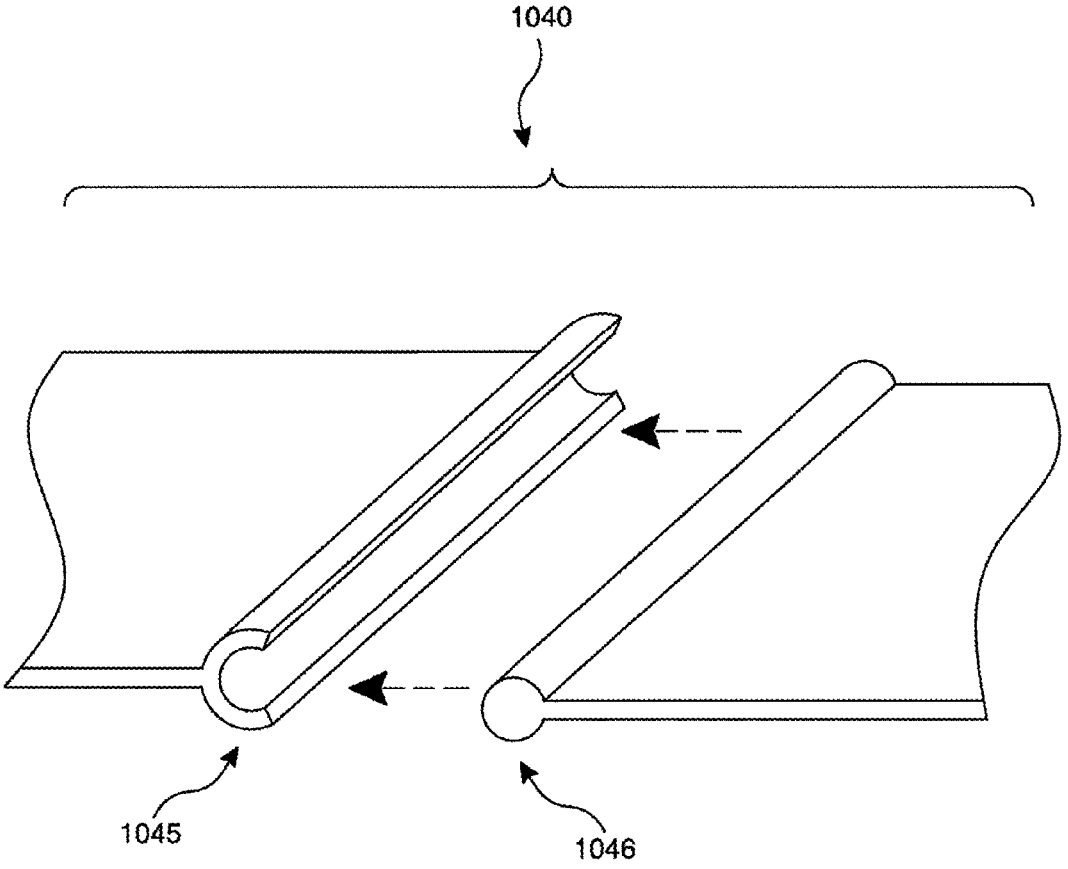
FIG. 2—A plan-view of a hinge of certain embodiments

Certain embodiments, shown in FIG. 1 and FIG. 2, comprise an attachment of a first end 1110 of a first extension to a first end 1020 of a scoop comprises a hinge 1040. A hinge 1040 as disclosed herein provides an attachment mechanism which allows rotational movement of a first extension 1100 about the first end 1110 of the first extension. Certain embodiments, shown in FIG. 2, comprise a hinge 1040 having hinge elements 1045 and 1046. The first hinge element 1045 mates with a second hinge element 1046 to provide rotational movement. Certain embodiments comprise a first extension 1100 attached to a scoop 1010 with a living hinge. A living hinge is appreciated to comprise a hinge mechanism using material that flexes to allow rotational movement. Other embodiments comprise a piano hinge, or other hinge mechanisms known to those skilled in the art.

Certain embodiments of the present invention, shown in FIG. 1, comprise a scoop 1010, a first extension 1100, and a second extension 1200. In such embodiments, a trailing edge 1060 of a scoop aligns with a trailing edge 1140 of a first extension and a trailing edge 1240 of a second extension. A leading edge 1130 of the first extension is further aligned with the leading edge 1230 of the second extension. Furthermore, a leading edge 1050 of the scoop is offset from the leading edge 1130 of the first extension.

Figure 3:
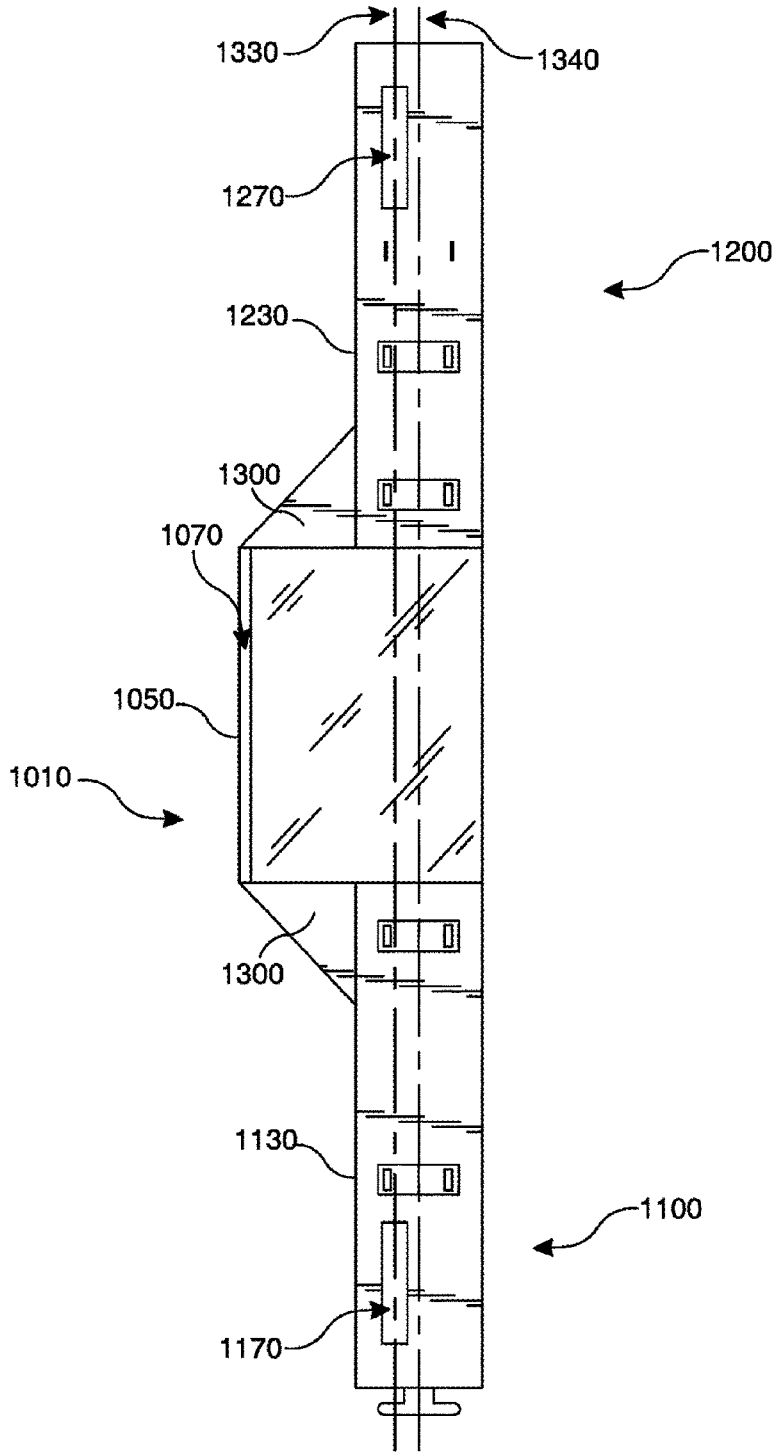
FIG. 3—A plan-view of embodiments in a flat-configuration

Certain embodiments, shown in FIG. 3, comprise a scoop 1010 having a leading edge 1050 offset from the leading edge 1130 of a first extension. Certain embodiments having a scoop 1010 and a first extension 1100, further comprise a gusset 1300. In such embodiments, a first gusset 1300 bridges between the leading edge 1130 of the first extension and the leading edge 1050 of the scoop. Some embodiments of the present invention comprising a first gusset 1300 further comprise a second gusset 1300 bridging between the leading edge 1050 of the scoop and the leading edge 1230 of a second extension 1200. A gusset comprises an independent piece of material affixed to the scoop 1010 and a first extension 1100. Certain embodiments comprise a first gusset 1300 affixed to the scoop 1010 and the first extension 1100, and a second gusset 1300 affixed to the scoop 1010 and the second extension 1200. Some embodiments comprise gussets 1300 which are integral portions of the first extension 1100 and the second extension 1200. It will be further appreciated that a first gusset 1300 and a second gusset 1300 as disclosed are proximal to but not required to be coincident with the leading edge 1050 of the scoop. In certain embodiments, a scoop 1010 comprises a leading edge 1050 further comprising a bevel 1070. A bevel 1070 provides a lower profile leading edge 1050 for increased ability to dispose debris over the leading edge 1050 and through the apparatus 1000 in a receptacle.

Figure 4A:
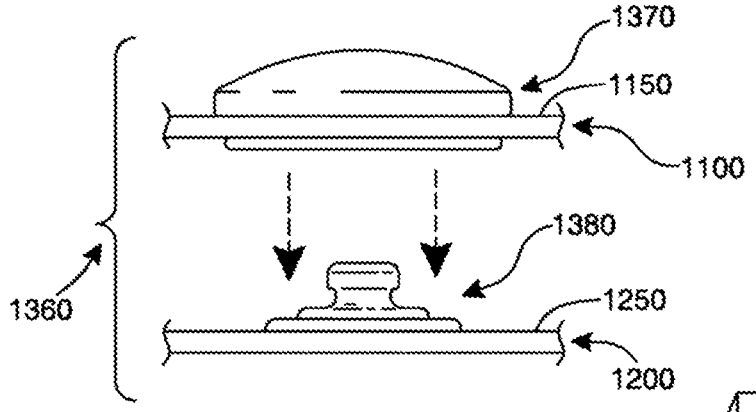
FIG. 4A—A close-up view of extension attachments of certain embodiments
Figure 4B:
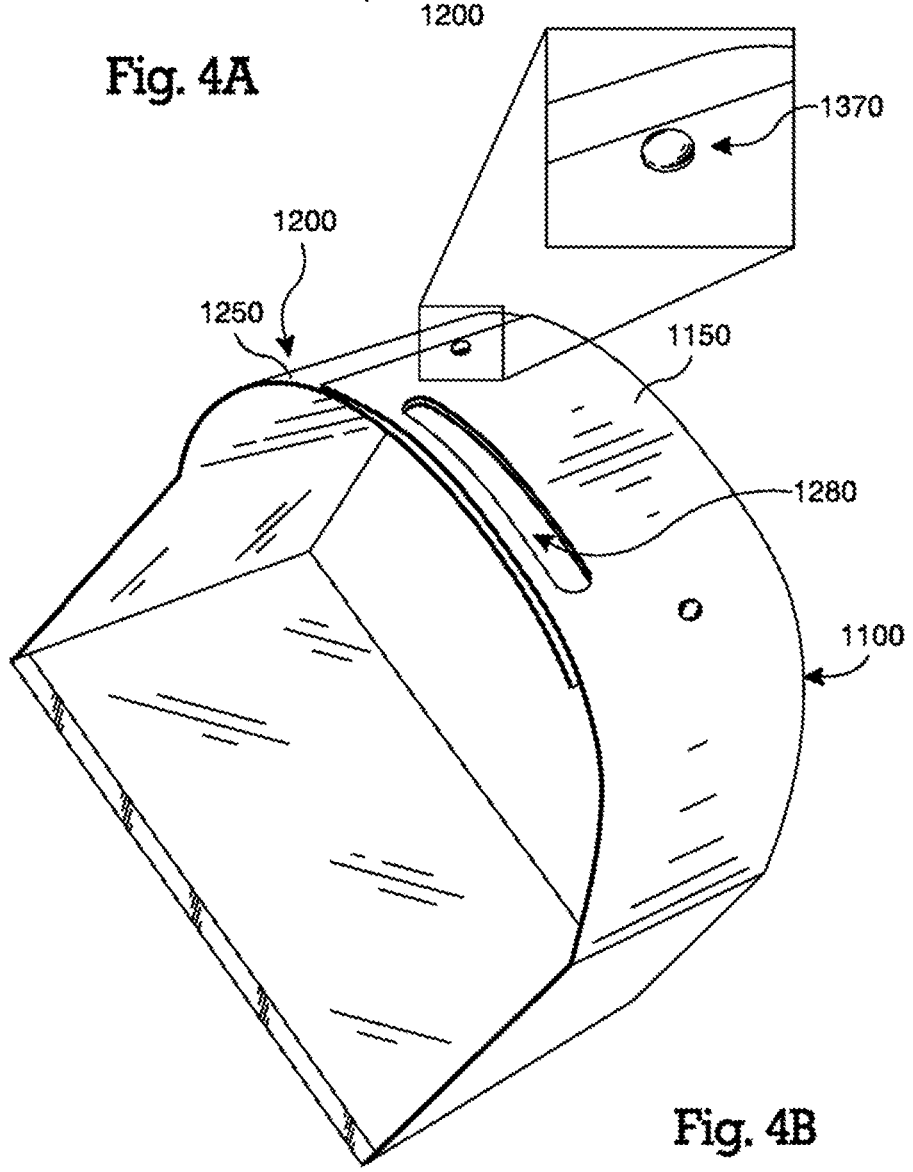

Certain embodiments of the present invention, shown in FIG. 4A and FIG. 4B, further comprise an extension attachment 1360. An extension attachment 1360, as disclosed, provides the ability to constrain a first extension 1100 to a second extension 1200 in a desired configuration. Certain embodiments of the present invention comprise an extension attachment 1360, and further comprise a first button snap 1370 and a second button snap 1380. A first button snap 1370 located on a first surface 1150 of a first extension is configured to mate with a second button snap 1380 on a first surface 1250 of a second extension. When mated, the first extension 1100 is constrained to the second extension 1200, thus configuring the apparatus in a hoop configuration, as shown in FIG. 4B.

Figure 5A:
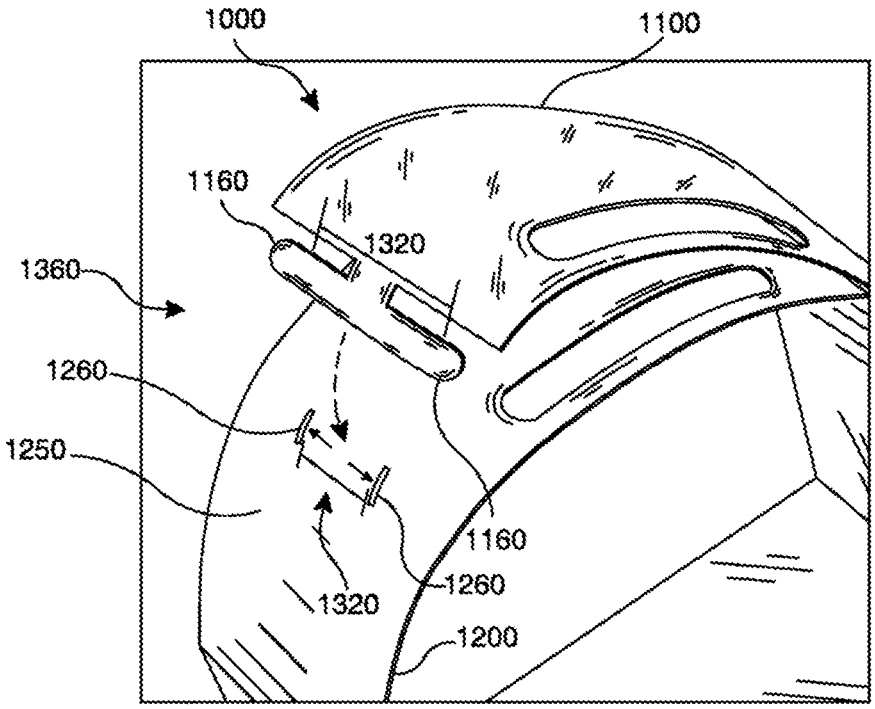
Figure 5B:
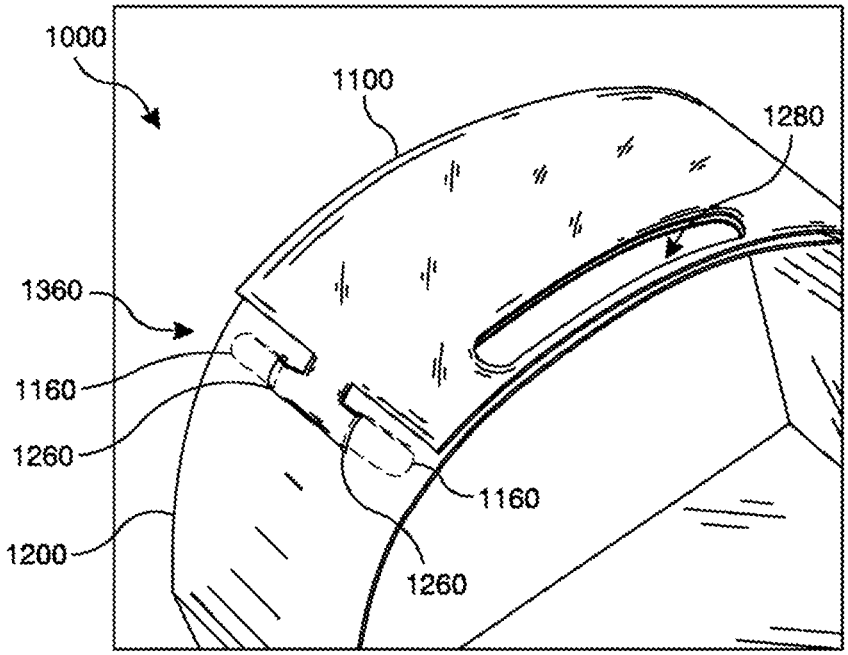

Certain embodiments of the present invention comprise an extension attachment 1360, referencing FIG. 5A and FIG. 5B, comprise a tab 1160 and a slot 1260. In such embodiments, a tab 1160 mates with and is retained by a slot 1260. In certain embodiments, a first tab 1160 is affixed to a first extension, proximal to a second end 1120. The first tab 1160 is configured to mate with and be retained by a first slot 1260 through the first surface 1250 of the second extension. When the first tab 1160 is mated with the first slot 1260, the first extension 1100 is constrained to the second extension 1200, thus configuring the apparatus 1000 in a hoop configuration, as shown in FIG. 4B. It will be appreciated that an apparatus may use a plurality of extension attachments 1360 to provide increased constraint between a first extension 1100 and a second extension 1200.

Certain embodiments, shown in FIG. 5A and FIG. 5B, comprise a first tab 1160 and a second tab 1160 affixed to the second end 1120 of the first extension. The first tab 1160 and the second tab 1160 are typically offset perpendicularly from the trailing edge 1140 of the first extension. The first tab 1160 and the second tab 1160 are separated by a first distance 1320. Certain embodiments further comprise a first slot 1260 and second slot 1260 through the second extension. The first slot 1260 is offset from the trailing edge 1240 such that the first slot 1260 is aligned with the first tab 1160. The second slot 1260 is offset from the first slot 1260 by the first distance 1320 such that the second slot 1260 is aligned with the second tab 1160.

Certain embodiments of the present invention, shown in FIG. 3, comprise a first extension 1100 having a first aperture 1170, and a second extension 1200 having a second aperture 1270. The placement of the first aperture 1170 and the placement of the second aperture 1270, are configured such that the fixation of a first extension 1100 to a second extension 1200 results in the alignment of the first aperture 1170 with the second aperture 1270, typically toward the top of the apparatus. In certain embodiments, a first aperture 1170 and a second aperture 1270 are coincident with an axis 1330 offset from, and parallel to, the trailing edge 1140 of the first extension. The first aperture 1170 is offset from the second end 1120 of the first extension, and the second aperture is offset from the second end 1220 of the second extension. The alignment of a first aperture 1170 with a second aperture 1270, serves to provide a handle 1280, shown in FIG. 4B and FIG. 5B. The handle 1280 allows a user to manipulate the apparatus when in use.

Figure 6A:
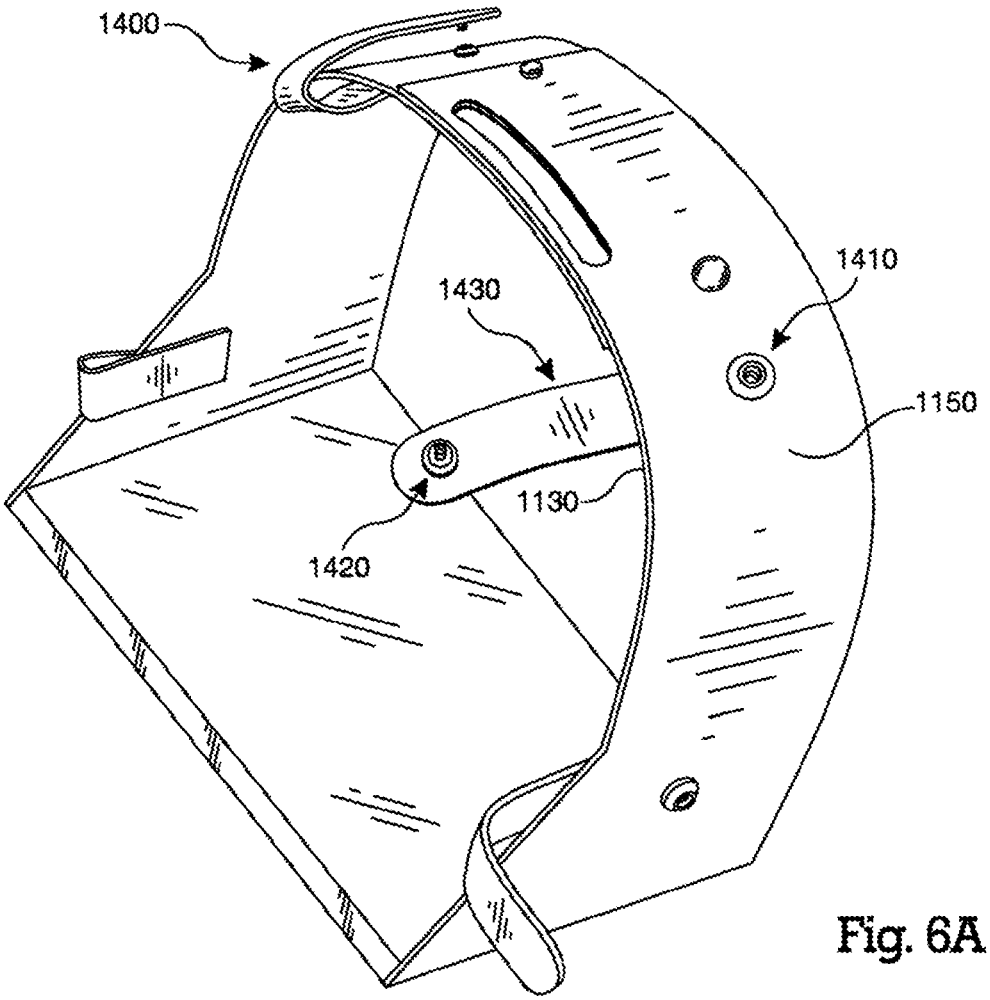
Figure 6B:
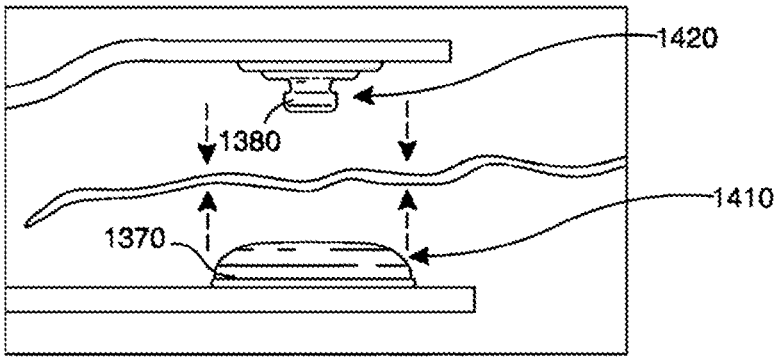

Certain embodiments, further comprise retention mechanisms 1400, shown in FIG. 6A and FIG. 6B, for the purpose of constraining a receptacle, such as a trash bag. A retention mechanism 1400, comprises a first retention component 1410 affixed to a first surface 1150 of an extension, and a second retention component 1420 affixed to a flexible protrusion 1430. A flexible protrusion 1430, is affixed to the leading edge 1130 of the first extension and allows the mating of the first retention component 1410 and the second retention component 1420. It will be appreciated that certain embodiments of the invention a first retention component 1410 and a second retention component 1420, further comprising a first button snap 1370 and a second button snap 1380.

Figure 7A:
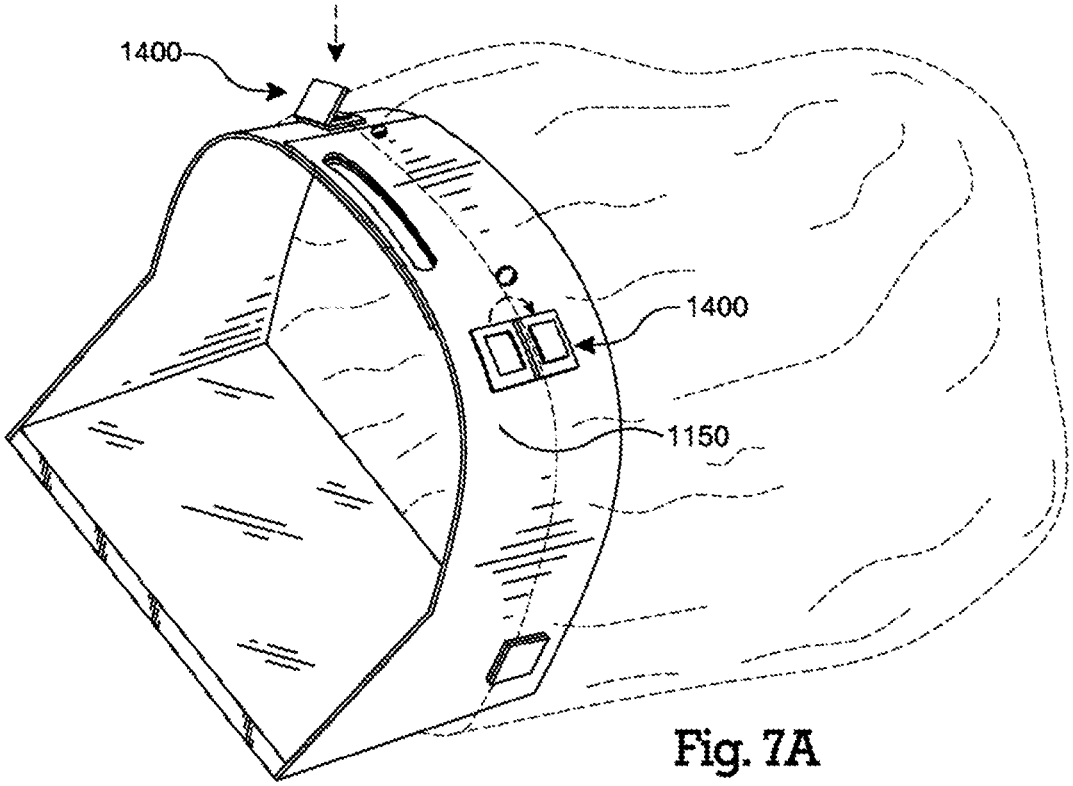
Figure 7B:
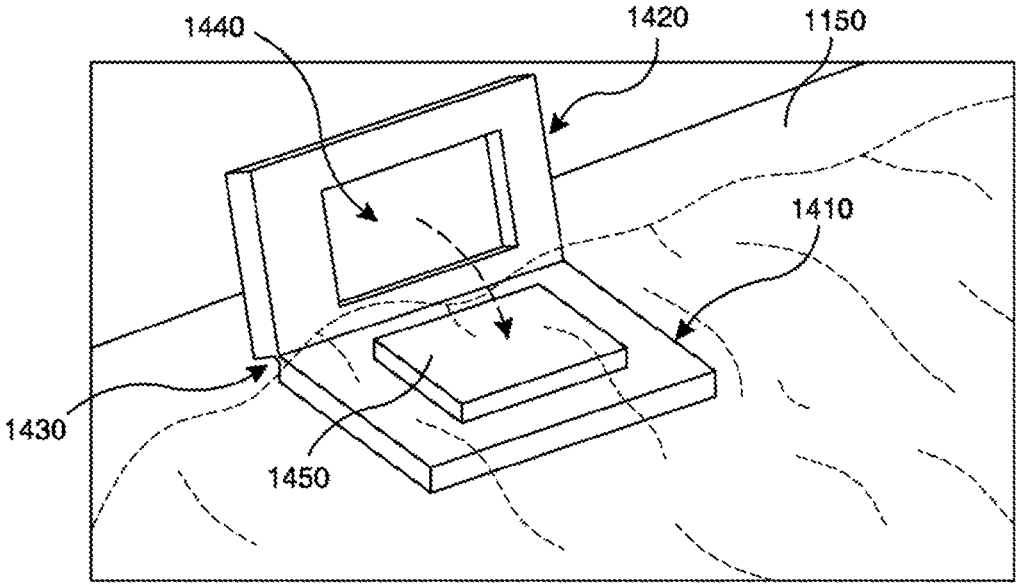

In certain embodiments, as shown in FIG. 7A and FIG. 7B, a retention mechanism 1400 comprises a first retention component 1410 and a second retention component 1420. The first retention component 1410, affixed to the first surface 1150 of a first extension comprises a volume 1450 having a profile. The profile of the volume 1450 comprises, but is not limited to a square, rectangle, circle, or a polygon. The second retention component 1420 is integrated with a flexible protrusion 1430 affixed to the first surface 1150 of the first extension and is configured to mate with the first retention component 1410. In such embodiments, the second retention component 1420 comprises an opening 1440 having a profile matching that of the first retention component 1410 and is configured to have an engineering fit with the first retention component 1410. An engineering fit will be appreciated to surround a location fit, RC fit, or other engineering fit such as those specified by ANSI B4.1 (Standard Tolerance Limits and Fits), incorporated by reference herein. It will be further appreciated that other engineering fits or assembly strategies known to those skilled in the art may be used while maintaining the inventive spirit of the present invention.

When the first retention component 1410, shown in FIG. 6A-FIG. 7B for example, is mated with a second retention component 1420 with a receptacle disposed therebetween, the receptacle is constrained to the apparatus. Certain embodiments of the present invention comprise a plurality of retention mechanisms 1400. In certain embodiments, shown in FIG. 3, a plurality of retention mechanisms 1400 are coincident with an axis 1340 offset from, and parallel to, the trailing edge 1140 of the first extension.

While various embodiments of the present invention have been described in detail, it is apparent that modifications and alterations of those embodiments will occur to those skilled in the art. However, it is to be expressly understood that such modifications and alterations are within the scope and spirit of the present invention. Further, the inventions described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as, additional items.

What is claimed is:

1. A debris collecting hoop comprising:

a center scoop located between and connected to a first extension and a second extension via hinges, said center scoop defining a leading scoop edge and a trailing scoop edge separated by a scoop width, said trailing scoop edge is in-line with a first extension trailing edge of said first extension and a second extension trailing edge of said second extension;

at least a substantial portion of a first leading edge consisting of a first linear edge that is parallel to said first extension trailing edge with a first width that is narrower than said scoop width, said first extension comprising said first leading edge;

at least a substantial portion of a second leading edge consisting of a second linear edge that is parallel to said second extension trailing edge with a second width that is narrower than said scoop width, said second extension comprising said second leading edge;

said first extension including a first fastener configured to mate with a second fastener to attach said first extension to said second extension forming said debris collecting hoop, said debris collecting hoop configured to be received by an open end of a plastic bag, said plastic bag defined by said open end and a closed end, said debris collecting hoop never covering said bag closed end; and said first extension and said second extension each possessing at least one pinch connector half that is configured to connect to an opposing pinch connector half in a mating relationship with a portion of a plastic bag interposed between said at least one pinch connector half and said opposing pinch connector half;

said first extension comprises a gusset with a first edge directly attached to said first linear edge and a second edge directly attached to said center scoop, a scoop-extension interface edge of said first extension is defined by the distance between said first extension trailing edge to where said gusset meets said leading scoop edge.

2. The debris collecting hoop of claim 1 wherein each of said extensions further comprise a slotted aperture that are configured to align when said extensions are fastened to form said debris collecting hoop, said aligned slotted apertures are a handle that is not obstructed by said plastic bag when connected to said debris collecting hoop via said at least one pinch connector half and said opposing pinch connector half.

3. The debris collecting hoop of claim 1 wherein said leading scoop edge comprises a bevel, said plastic bag never extends over said first or said second leading edge.

4. The debris collecting hoop of claim 1 wherein said scoop-extension interface edge attaches entirely along one of said hinges.

5. The debris collection hoop of claim 1 wherein said pinch connector half is selected from a group consisting of a) a snap arrangement that connects with an opposing snap arrangement on a strap, and b) a hinged frame and button arrangement, said pinch connector half only cooperating with said opposing pinch connector half if said plastic bag does not wraps around any portion of said leading scoop edge, said first leading edge, or said second leading edge.

6. A leaf and debris collecting hoop comprising:

a center scoop located between and connected to a first extension and a second extension, said center scoop defining a leading scoop edge and a trailing scoop edge separated by a scoop width, said trailing scoop edge is in-line with a first extension trailing edge of said first extension and a second extension trailing edge of said second extension;

a substantial portion of a first leading edge comprising a first linear edge that is parallel to said first extension trailing edge is defined by a first width that is narrower than said scoop width;

a substantial portion of a second leading edge comprising a second linear edge that is parallel to said second extension trailing edge having a second width that is narrower than said scoop width;

means for bending said first extension and said second extension about said center scoop in a hoop shape;

means for fastening together the first extension and the second extension, said means for fastening including a first fastener on said first extension and a second fastener on said second extension; and means for fixedly connecting a plastic bag to said leaf collecting hoop while in said hoop shape without ever wrapping around said leading scoop edge or said first or said second leading edges;

said leaf and debris collecting hoop has exactly two hinges, a first hinge connecting said first extension to said center scoop and a second hinge connecting said second extension to said center scoop.

7. The leaf and debris collecting hoop of claim 6 further comprising means for making a handle comprising a first handle aperture in said first extension and a second handle aperture in said second extension.

8. The leaf and debris collecting hoop of claim 6 wherein said leading scoop edge in plane with said trailing scoop edge and any other location in said scoop.

9. The leaf and debris collecting hoop of claim 6 further comprising a means for bridging said leading scoop edge with said first extension and said second extension.

10. The debris collecting hoop of claim 1 wherein said debris collection hoop has exactly two hinges, a first hinge connecting said first extension to said scoop and a second hinge connecting said second extension to said scoop.

11. The debris collection hoop of claim 2 further comprising a joined pinch connector defined by one of said pinch connector halves connected to one of said opposing pinch connector halves, said first extension possessing a first joined pinch connector that is closer to said first extension trailing edge than a first of said slotted apertures and said second extension possessing a second joined pinch connector that is closer to said second extension trailing edge than a second of said slotted apertures.

12. A debris collecting hoop comprising:

a center scoop defined by a leading scoop edge and a trailing scoop edge separated by a scoop width, a first scoop side connected to a first hinge, and a second scoop side connected to a second hinge;

a first extension connected to said center scoop via said first hinge;

a second extension connected to said center scoop via said second hinge;

said trailing scoop edge is in-line with a first extension trailing edge of said first extension and a second extension trailing edge of said second extension;

a substantial portion of a first leading edge is linear and is parallel to said first extension trailing edge with a first width that is narrower than said scoop width, said first extension comprising said first leading edge;

a substantial portion of a second leading edge is linear and parallel to said second extension trailing edge with a second width that is narrower than said scoop width, said second extension comprising said second leading edge;

said first extension possessing a first pinch connector half that is configured to connect to an opposing first pinch connector half in a mating relationship that defines a first closed pinch connector;

said second extension possessing a second pinch connector half that is configured to connect to an opposing second pinch connector half in a mating relationship that defines a second closed pinch connector;

said first extension including a first fastener;

said second extension including a second fastener, said first and said second fasteners configured to connect said first extension to said second extension forming said debris collecting hoop;

said first extension comprising a first elongated aperture essentially parallel to said first leading edge;

said second extension comprising a second elongated aperture, said elongated apertures are configured to align when said first and said second extensions are connected in said debris collecting hoop, said aligned elongated apertures are a handle, said first closed pinch connector closer to said first trailing edge than said first elongate aperture and said second closed pinch connector closer to said second trailing edge than said second elongated aperture; and wherein there are no more and no less than two hinges.

13. The debris collecting hoop of claim 12 further comprising a first triangular gusset extending from said first leading edge to said first scoop side and a second triangular gusset extending from said second leading edge to said second scoop side.

14. The debris collecting hoop of claim 12 defined by a unitary sheet of material.

15. The debris collecting hoop of claim 12 wherein said center scoop, said first extension and said second extension are a unitary piece of material.

16. The debris collecting hoop of claim 12 wherein said center scoop is essentially permanently flat when said first extension and said second extension are bent to form said debris collecting hoop.

* * * * *